US005353962A

United States Patent [19]

Scholz et al.

[11] Patent Number: 5,353,962

[45] Date of Patent: Oct. 11, 1994

[54] DISPENSER WITH AN ENERGY STORAGE MEMBER

[75] Inventors: Michael P. Scholz, San Clemente; Joe J. Lones, San Diego; Franz Rank, Inglewood, all of Calif.

[73] Assignee: Williams Dispenser Corporation, Los Angeles, Calif.

[21] Appl. No.: 5,275

[22] Filed: Jan. 19, 1993

[51] Int. Cl.[5] ..... N65D 35/00; N65D 83/00

[52] U.S. Cl. ..... 222/95; 222/105; 222/326; 222/340; 222/390

[58] Field of Search ..... 222/340, 390, 326, 95, 222/105

[56] References Cited

U.S. PATENT DOCUMENTS

| | | | |
|---|---|---|---|
| 1,342,450 | 6/1920 | Kost et al. | 222/340 |
| 1,476,946 | 12/1923 | Bessesen | 222/340 |
| 1,664,936 | 4/1928 | Lyman | 222/340 |
| 2,748,991 | 6/1956 | McCarthy | 222/326 X |
| 4,193,513 | 3/1980 | Bull, Jr. | 222/340 X |

FOREIGN PATENT DOCUMENTS

| | | | |
|---|---|---|---|
| 669856 | 8/1929 | France | 222/390 |
| 2208113 | 3/1989 | United Kingdom | 222/95 |
| 8807963 | 10/1988 | World Int. Prop. O. | 222/95 |

*Primary Examiner*—Andres Kashnikow
*Assistant Examiner*—Anthoula Pomrening
*Attorney, Agent, or Firm*—Burns, Doane, Swecker & Mathis

[57] ABSTRACT

A spray dispenser includes an outer body, a product bag containing a liquid product disposed in the outer body, and a valve disposed at an upper end of the outer body. An elastic energy-storing member is disposed below the bag, and an energizing member is disposed below the energy-storing member for compressing the latter. The energizing member is raised by rotation of a threaded post which extends through the energizing member in threaded connection therewith. The post comprises a plurality of screws telescopingly arranged to define separate stages of operation, whereby the screws move from a retracted relationship to an extended relationship as the energizing member moves upwardly.

9 Claims, 3 Drawing Sheets

DISPENSER WITH AN ENERGY STORAGE MEMBER

BACKGROUND OF THE INVENTION

The present invention relates to a dispenser, especially a hand-held spray dispenser in which a spray is emitted upon manual actuation of a valve.

For many years spray dispensers for dispensing products such as hair spray, deodorants, room air fresheners, etc., have utilized a container in which the product is stored in liquid form. A propellant gas under pressure occupies a head space between the top of the container and the liquid product. A dip tube extends downwardly through the propellant and product from a discharge valve located at the top of the container. When a user opens the discharge valve, the propellant pushes the liquid product into the bottom of the dip tube and then upwardly through the dip tube to the valve.

Propellant gases which have commonly been used have included butane and pentane, for example. Those gases feature the ability to become dissolved within the liquid product under the usual pressure conditions occurring within the container. Hence, the product is discharged in the form of liquid particles mixed with bubbles of the propellant gas. When exposed to the lower atmospheric pressure, those bubbles expand suddenly to advantageously break up the liquid particles into a finer spray pattern.

The conventional propellant gases have exhibited ideal product-expelling characteristics, i.e., an essentially constant pressure of a specified magnitude which can be maintained continuously for a specified duration of time.

More recently, however, due to concerns about environmental pollution, conventional propellant gases have fallen into disfavor. Alternative sources of propulsion have been sought which will satisfy the above-mentioned product-expelling characteristics without being accompanied by the discharge of polluting gases.

Dispensers have heretofore been proposed which employ an internal energy-storing member capable of being mechanically compressed by a rotatable actuator to pressurize a liquid product, e.g., see U.S. Pat. Nos. 3,195,168; 3,951,310; and 5,042,696.

In U.S. Pat. No. 3,951,310 there is disclosed an arrangement wherein a post extends vertically upwardly from a lower end of the container. The post is connected to a manually rotatable bottom cap of the dispenser so as to be rotatable therewith. The post extends through an energizing piston or follower member for rotating the latter. The energizing member is threadedly connected to an outer cylinder. As the cap and post are rotated, the piston is induced to move upwardly and compress an energy storing spring operatively disposed between the piston and the bottom of a product bag. This places the product under compression so that the product is expelled through a top valve when the latter is actuated. When the stored energy of the spring is depleted, the cap and post are again rotated to recompress the spring. However, it will be appreciated that in order for the piston to be able to travel upwardly sufficiently far to ensure that all or most of the product is expelled, the post must extend to a relatively high elevation within the dispenser. This means that the product bag must be provided with a relatively deep cavity at its lower end to receive the upper end of the post. The presence of this cavity serves to reduce the effective volume of the bag. Also the wall of the cavity must be reinforced to maintain its shape, thereby increasing the cost and complexity of manufacturing the bag.

It would, therefore, be desirable to provide a dispenser which does not appreciably reduce the effective volume of the product bag and which does not require bag cavity reinforcement.

SUMMARY OF THE INVENTION

The present invention relates to a spray dispenser which comprises an outer body and a flexible bag disposed in the outer body. The bag contains a liquid product to be dispensed. A valve is disposed at an upper end of the outer body in communication with the interior of the bag. An elastic energy-storing member is disposed below the bag and is mounted for vertical movement in the outer body. An energizing member is disposed below the energy-storing member and is mounted for vertical movement in the outer body relative to the energy-storing member for compressing the energy-storing member and thereby pressurizing the product in the bag. A manually rotatable member is mounted to the outer body. A drive mechanism is connected to the manually rotatable member and to the energizing member for vertically moving the energizing member in response to rotation of the manually rotatable member. The drive mechanism includes a post projecting upwardly through the energizing member. The energizing member is vertically movable relative to the post. The post includes a plurality of telescoping sections which are vertically movable relative to one another such that the sections move from a retracted relationship to an extended relationship as the energizing member moves upwardly.

Preferably, the post sections comprise screws which are threadedly interconnected in telescoping relationship. One of the screws is connected to the manually rotatable member for rotation therewith, and another of the screws extends through the energizing member and is threadedly connected therewith such that the other screw and the energizing member move vertically together relative to the one screw during one stage of dispensing operation. Moreover, the energizing member moves vertically relative to the other screw during another stage of dispensing operation.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
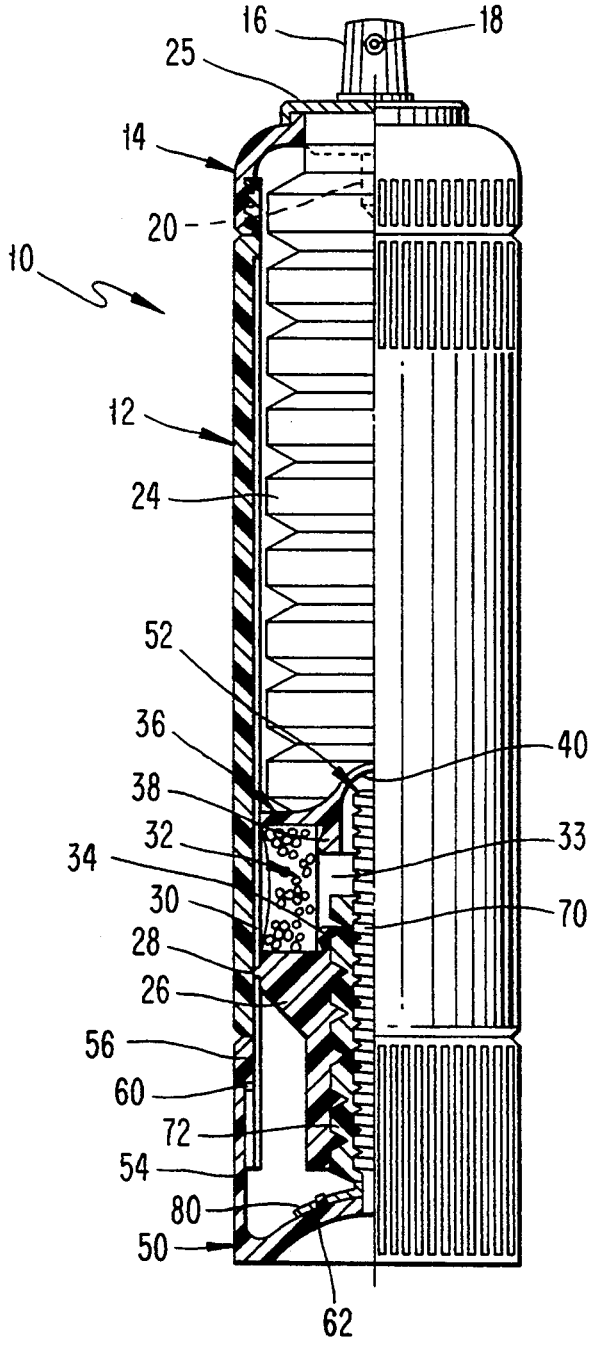
FIG. 1 is a side elevational view of a dispenser according to the present invention, with one-half of the dispenser broken away.

A dispenser 10 comprises a cylindrical outer body 12 having an external thread at its upper end for threadably receiving an internally threaded top cap 14. The top cap carries an actuator in the form of a conventional manually actuable valve 16. The valve 16 includes an outlet 18 and a downwardly projecting stem 20 having an inlet formed in its side or bottom. The inlet communicates the valve outlet with the interior of a product-containing bag 24 that is carried by the top cap. The bag is in the form of a flexible, longitudinally collapsible bellows, although any suitable configuration could be employed. The top cap 14, actuator 16, and bag 24 are connected together to form a unit which can be removed from the body 12 by unscrewing the top cap. Preferably, a plate portion 25 of the valve is crimped against an inner edge of the top cap, with an upper end of the bag sandwiched therebetween.

Figure 2:
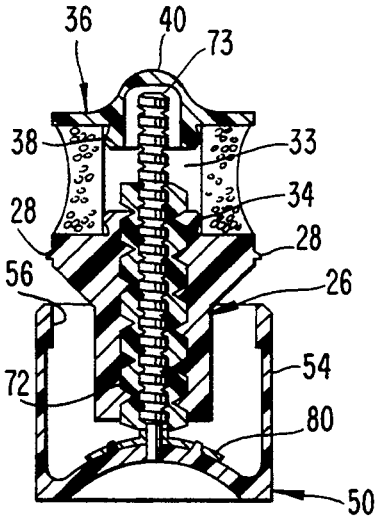
FIGS. 2, 3 and 4 depict, in longitudinal section, components of the dispenser in various stages of vertical movement.

Located in a lower end of the body 12 is an energizing member 26 having a cylindrical portion from which a plurality of guide projections 28 project radially outwardly (see FIG. 2). Those guide projections are slidably disposed in respective vertical channels formed in an inside surface of the outer body 12 to prevent the energizing member 26 from rotating, while permitting it to move vertically by means to be later described.

Disposed atop the energizing member 26 is an elastic energy storing member 32 in the form of a plastic foam element wherein at least a substantial majority of the cells thereof are closed. The foam element includes a central orifice 33 into which a projection 34 of the energizing member 26 extends. Attention is directed to copending patent application Ser. No. 07/851,804, filed Mar. 16, 1992 for a disclosure of such an energy storing foam member. The disclosure of that application is incorporated herein by reference. Foams of that type are characterized by a multitude of tiny, gas-filled, closed cells encased within a plastic matrix or bonding agent, such as urethane for example. When the foam is compressed, the gas-filled cells are collapsed, thereby storing energy to pressurize the product disposed in the bag. As the product is discharged, the cells expand, thereby dissipating the stored energy. One type of such foam which has been found acceptable is that manufactured and sold by Freudenberg-NOK of Plymouth, Mich. under the designation AUZ 2500.

The closed-cell foam behaves like an elastomer and has very low compression set. Even though the internal gas cells are collapsed when the foam is compressed, there occurs some lateral bulging of the element. By providing the foam element in a generally hourglass form with an appropriately size concave side wall, any lateral (radial) bulging occurring during compression will not increase the diameter of the element appreciably beyond its maximum diameter at the top and bottom ends.

By varying the size of the foam cells and the type of matrix material, the density and stiffness of the foam element can be changed. By selecting a suitable density and stiffness, as well as a suitable height and shape of the foam element, the foam element can be tailored to properly pressurize liquid products of a wide variety of viscosities, in order to achieve suitable discharge flow volumes of the products.

Seated atop the energy-storing member 32 is a disk 36 which includes a downward mounting projection 38 received in a central orifice 33 of the energy storing member 32. The disk 36 also includes an upward dome-shaped protuberance 40 which protrudes against and deforms the lower surface of the product bag 24.

The energizing member 26, the energy-storing member 32, and the disc 36 form a unit which is able to ascend and descend within the outer body 12. Such movement of the unit is produced by a manually actuated mechanism which includes a bottom cap 50 and a vertical post 52. The bottom cap 50 includes an outer skirt 54 having a radially inwardly projecting lip 56 at its upper end. That lip 56 is rotatably received in a radially outwardly open annular groove formed in an outer surface of the outer body 12. A thrust bearing ring 60 is interposed between vertically opposed surfaces of the lip 56 and groove to facilitate rotation of the bottom cap about the vertical center axis of the outer body 12.

The post 52 projects upwardly from a dome-shaped bottom wall 62 of the bottom cap 50 and is rotatable therewith. The post 52 is formed of multiple telescoping sections. That is, the post is in the form of a telescoping screw assembly comprised of two externally threaded screws 70, 72 which define two screw stages. The first-stage screw 70 is mounted to the bottom wall 62 and extends through the energizing member 26 and the energy storing member 32, and terminates within the protuberance 40. The second-stage screw 72 has an internal thread which mates with the external thread of the first-stage screw 70. Moreover, the second-stage screw 72 extends through the energizing member 26 and is threadably connected thereto. Preferably, the screws possess a buttress type thread with a shallow flank angle, i.e., less than 7 degrees, preferably zero degrees.

Figure 3:
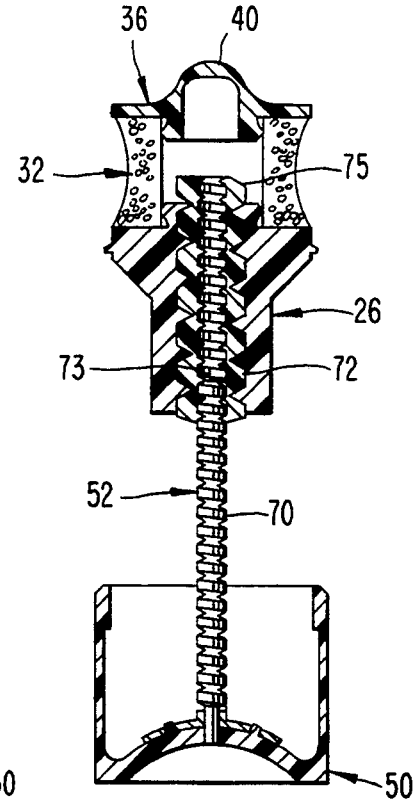
Figure 6:
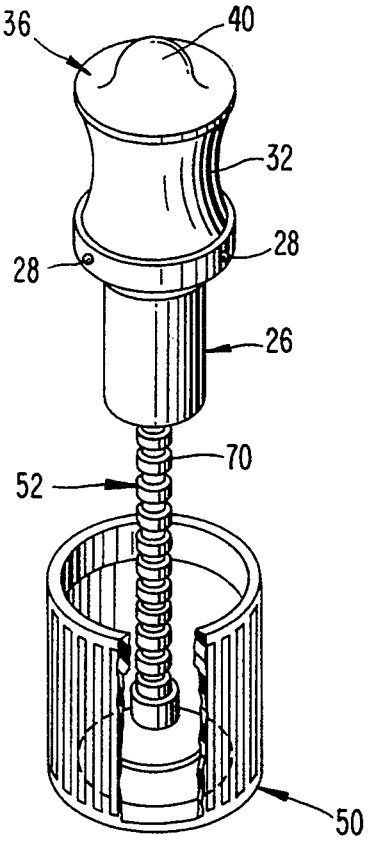

When rotation is imparted to the post by a user who rotates the bottom cap 50, torque will tend to be transmitted from the first-stage screw 70 to the second-stage screw 72, and from the second-stage screw 72 to the energizing member 26. However, the guide projections 28 of the energizing member prevent the latter from rotating. Moreover, because the external thread of the second-stage screw 72 has a larger surface area than the internal thread of the first-stage screw 70, the frictional resistance to relative rotation between the energizing member 26 and the second-stage screw 72 is greater than the frictional resistance to rotation between the second-stage screw 72 and the first-stage screw 70. Consequently, the first-stage screw 70 rotates relative to the second-stage screw 72, causing the second-stage screw 72 and the energizer member 26 to travel vertically as a unit relative to the first-stage screw 70 (see FIGS. 3 and 6). This produces compression of the energy storing member 32 and a pressurizing of the contents of the bag 24, whereby an ejection of the contents from the dispenser is possible by opening the valve 16. The unit composed of the energizing member 26 and the second-stage screw 72 can be repeatedly moved vertically whenever the energy of the energy-storing member 32 has been depleted. Eventually, the unit 26, 72 reaches a maximum vertical displacement relative to the first-stage screw 70, whereupon the screw 72 abuts a stop cap 73 provided at the upper end of the helical channel of the screw 70 in order to terminate vertical travel of the unit 26, 72.

Figure 4:
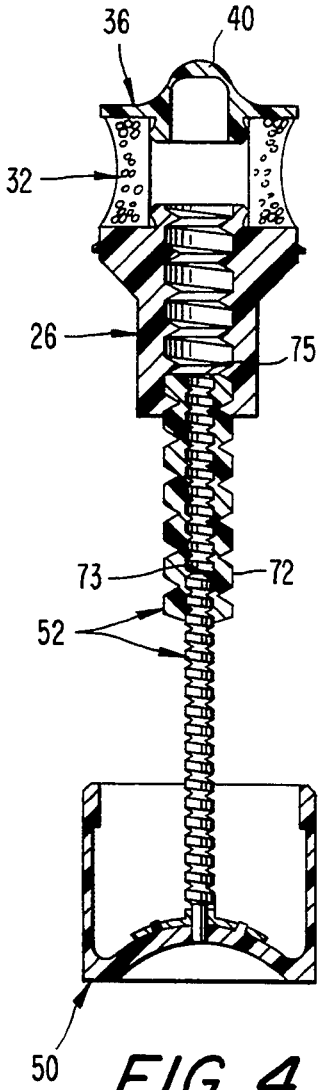
Figure 7:
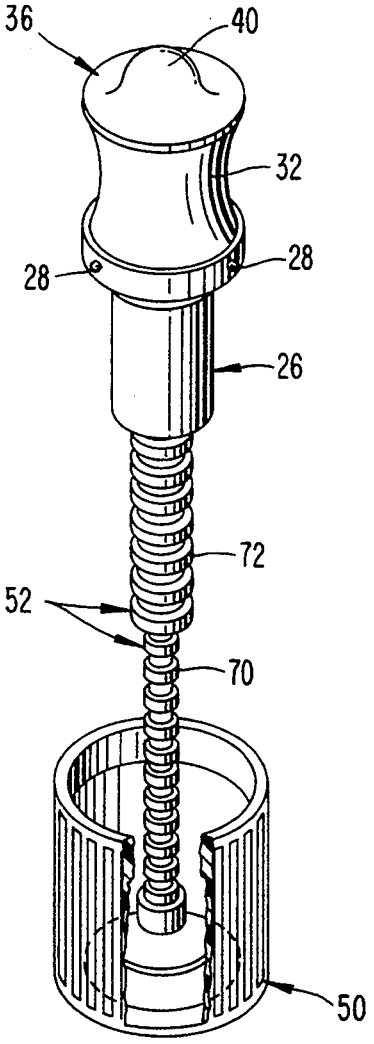

Thereafter, continued rotation of the bottom cap 50 and screw 70 causes the second-stage screw 72 to begin rotating relative to the energizing member 26, causing the energizing member 26 to be displaced vertically relative to the second-stage screw 72 (see FIGS. 4 and 7). Eventually, the energizing member 26 contacts a stop cap 75 located at the upper end of the helical channel of the screw 72 in order to terminate vertical travel of the energizing member 26. At that point, there can be no further pressurizing of the bag contents.

Figure 5:
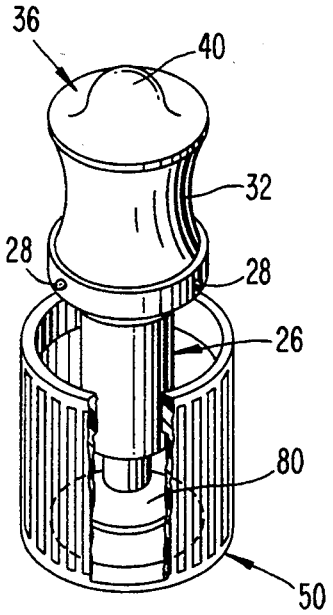
FIGS. 5, 6 and 7 are perspective views of the components depicted in FIGS. 2, 3 and 4, respectively.

It will be appreciated that the screws 70, 72 will move from a retracted relationship (FIGS. 2 and 5) to an extended relationship (FIGS. 3, 4, 6, 7) as the energizing member 26 moves upwardly.

When no further expulsion of product is possible, the product bag 24 can be replaced by a user who unscrews the top cap 14 from the outer body 12 in order to remove the top cap 14, the valve 16, and the empty bag 24 as a unit from the outer body 12. Then, the bottom cap 50 is rotated in a reverse direction so that the disk 36, the energy-storing member 32, the energizing member 26, and the second-stage screw 72 can be returned to their lower position. Then, a replacement unit 14, 16, 24 is inserted into the outer body 12, and the top cap 14 of the replacement unit is screwed onto the outer body 12.

The present invention provides a dispenser which enables an energy storing member to be repeatedly energized by a vertical post without requiting that the bag be reinforced and without sacrificing an appreciable volume of the bag.

The components of the dispenser can be formed of any suitable materials, such as metal or plastic for example. For example, the outer body 12, the bottom cap 50, the screws 70, 72, the energizing member 26, and the plate 36 could be formed of plastic.

If desired, a metal pressure plate 80 can be placed on the bottom wall 62 of the cap 50 in order to distribute the forces from the screw more evenly across that bottom wall 62.

While a two-stage screw arrangement 70, 72 has been disclosed herein, it will be appreciated that more than two screw stages could be provided. However, it has been found that two stages are desirable in order to avoid an excessive resistance to rotation of bottom cap 50 due to an accumulation of friction acting on the various screw stages. It will also be appreciated that the pitch and size of the screw threads may vary, depending upon the size of the dispenser and/or the type of product being dispensed.

It may also be desirable to place an overload prevention device between the bottom cap 50 and the first-stage screw 70, or between the energizing member 26 and the final stage screw 72, in order to release the drive connection between those elements once the bag has been pressurized to a predetermined level.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A spray dispenser, comprising:

an outer body;

a flexible bag containing liquid product disposed in said outer body;

a valve disposed at an upper end of said outer body and communicating with the interior of said bag;

an elastic energy-storing member disposed below said bag and mounted for vertical movement in said outer body;

an energizing member disposed below said energy-storing member and being mounted for vertical movement in said outer body relative to said energy-storing member for compressing said energy-storing member and thereby pressurizing the product in said bag, said energizing member and said outer body being interconnected by vertical guide means permitting said energizing member to move vertically relative to said outer body while preventing said energizing member from rotating relative to said outer body; and actuating means for vertically raising said energizing member in said outer body, comprising:

a manually rotatable member mounted to said outer body, and a post connected to said manually rotatable member and projecting vertically centrally upwardly within said outer body, said post including a plurality of screws threadedly interconnected in telescoping relationship, one of said screws being connected to said manually rotatable member for rotation therewith, and another of said screws being threadedly connected with said energizing member such that said another screw and said energizing member move vertically together relative to said one screw during one stage of dispensing operation, and said energizing member moves vertically relative to said another screw during another stage of dispensing operation, said screws moving from a retracted to an extended relationship as said energizing member moves upwardly.

2. A spray dispenser according to claim 1 wherein there are only two said screws.

3. A spray dispenser according to claim 1 including a disk disposed between said energy-storing member and said bag, said disk including a protuberance protruding against the bottom of said bag, said post extending into said protuberance when the screws are in said retracted relationship.

4. A spray dispenser according to claim 1 wherein said manually rotatable member comprises a bottom cap mounted on a lower end of said outer body for rotation about a longitudinal axis of said outer body, said post extending upwardly from said bottom cap.

5. A spray dispenser according to claim 1 wherein said energy-storing member comprises a closed-cell plastic foam member.

6. A spray dispenser according to claim 5 wherein said foam member comprises a central opening, said energizing member including a projection received in said opening.

7. A spray dispenser according to claim 1 including a top cap threadedly attached to said outer body, said valve and said bag being attached to said top cap for removal from said outer body when said top cap is detached therefrom.

8. A spray dispenser according to claim 1 wherein said screws possess a buttress thread with a flank angle less than seven degrees.

9. A spray dispenser comprising:

an outer body;

a flexible bag containing liquid product disposed in said outer body;

a valve disposed at an upper end of said outer body and communicating with the interior of said bag;

an elastic energy-storing body formed of a closed-cell plastic foam disposed below said bag and mounted against rotational movement and for vertical movement in said outer body for compressing said energy-storing body and thereby pressurizing the product in said bag; and an energizing member disposed below said energy-storing body and being mounted for vertical movement in said outer body relative to said energy-storing body for compressing said energy-storing body and thereby pressurizing the product in said bag, said energizing member and said outer body being interconnected by vertical guide means permitting said energizing member to move vertically relative to said outer body while preventing said energizing member from rotating relative to said outer body;

actuating means for vertically raising said energizing member in said outer body, comprising:

a manually rotatable member mounted to said outer body, and a post connected to said manually rotatable member and projecting vertically centrally upwardly within said outer body, said post including only first and second screws threadedly interconnected in telescoping relationship to define a first-stage screw and a final-stage screw, respectively, said first-stage screw being connected to said manually rotatable member for rotation therewith, and said final-stage screw being threadedly connected therewith said energizing member such that said final-stage screw and said energizing member move vertically together in response to rotation of said manually rotatable member during one stage of dispensing operation, and said energizing member moves vertically relative to said final stage screw in response to rotation of said manually rotatable member during another stage of dispensing operation.

* * * * *